US006662704B2

(12) United States Patent
Nelson

(10) Patent No.: US 6,662,704 B2
(45) Date of Patent: Dec. 16, 2003

(54) APPARATUS AND METHOD FOR GENERATING POWER FROM A FLOWING LIQUID

(75) Inventor: Rianey E. Nelson, Tampa, FL (US)

(73) Assignee: Internal Command International, Tampa, FL (US)

( * ) Notice: Subject to any disclaimer, the term of this patent is extended or adjusted under 35 U.S.C. 154(b) by 28 days.

(21) Appl. No.: 10/015,496

(22) Filed: Dec. 12, 2001

(65) Prior Publication Data

US 2003/0106418 A1 Jun. 12, 2003

(51) Int. Cl.[7] ..... F01L 25/02
(52) U.S. Cl. ..... 91/314; 91/344
(58) Field of Search ..... 91/304, 314, 344; 417/401

(56) References Cited

U.S. PATENT DOCUMENTS 3,260,212 A 7/1966 Johnson
3,971,213 A * 7/1976 Kelley ..... 91/304
4,142,367 A 3/1979 Guisti ..... 60/325
4,731,545 A 3/1988 Lerner et al. ..... 290/54
5,043,592 A 8/1991 Hochstrasser ..... 290/52
6,272,968 B1 * 8/2001 Ropponen ..... 91/314

* cited by examiner

*Primary Examiner*—Edward K. Look
*Assistant Examiner*—Michael Leslie
(74) *Attorney, Agent, or Firm*—Carlton Fields P.A.

(57) ABSTRACT

This invention provides an apparatus and a method for generating power from a flowing liquid. The apparatus has three main components. The first component is a control unit for selectively directing the flowing liquid to the second component, the power unit, which is responsible for generating power. The third component, a reversing unit, is used to adjust the control unit between two control unit configurations. The method involves the manner in which the liquid is passed and directed through the apparatus in order to generate power.

3 Claims, 11 Drawing Sheets

APPARATUS AND METHOD FOR GENERATING POWER FROM A FLOWING LIQUID

BACKGROUND OF THE INVENTION

This invention relates generally to the production of power, and more particularly to an apparatus and method for generating power by utilizing the force of a flowing liquid.

The need to generate power in times of crisis and the need to generate power from a relatively inexpensive resource have long been felt. Inventors have tried for some time to create an apparatus and method that will generate power for little cost. The ability to generate power from an inexpensive resource when access to traditional power, namely power supplied by a power company, is not available due to power shortages or natural disasters is needed.

Also, in times when emergency power is not required, the ability to generate such power assists in preserving the environment by lessening the burden on power companies to provide power, and the ability to generate power would save consumers money on monthly electric bills. The need to generate power from an inexpensive resource will become of even more importance as other more expensive resources of the world dwindle and disappear over the course of time.

There have been attempts in the prior art to harness the kinetic energy of a flowing liquid in order to generate power. However, these attempts are either impractical, difficult to scale, difficult to distribute, awkward to use, or simply will not work. Therefore, an apparatus and method are needed that generates power from a flowing liquid.

SUMMARY OF THE INVENTION

This invention provides an apparatus and a method for generating power from a flowing liquid. The invention provides an apparatus comprising a control unit selectively operable between a first control unit configuration and a second control unit configuration for receiving the flowing liquid and selectively directing the flowing liquid to a first power unit aperture when the control unit is in the first control unit configuration, and selectively directing the flowing liquid to a second power unit aperture when the control unit is in the second control unit configuration; a power unit for generating power, including: (1) a power chamber having the first power unit aperture for receiving the flowing liquid from the control unit, and a second power unit aperture for receiving the flowing liquid from the control unit, (2) a power operator operable between a first power operator position and a second power operator position and disposed within the power chamber, operatively configured so the power operator becomes disposed in the first power operator position when the control unit is disposed in the first control unit configuration, and so that the power operator becomes disposed in the second power operator position when the control unit is disposed in the second control unit configuration, and (3) a power transmission linkage operatively communicating with said power operator for transmitting power as said power operator reciprocates between said first power operator position and said second power operator position; and a reversing unit to adjust the control unit configuration to become disposed in the first control unit configuration when the power operator becomes disposed in the second power operator position, and to adjust the control unit configuration to become disposed in the second control unit configuration when the power operator becomes disposed in the first power operator position.

The invention provides a method comprising passing the flowing liquid to a control unit selectively operable between a first control unit configuration and a second control unit configuration; directing, selectively, the flowing liquid to a first power unit aperture when said control unit is in said first control unit configuration, and selectively directing said flowing liquid to a second power unit aperture when said control unit is in said second control unit configuration; forcing a power operator operable between a first power operator position and a second power operator position and disposed within the power unit, to the first power operator position when receiving flowing liquid from the first power unit aperture and to the second power operator position when receiving flowing liquid from the second power unit aperture; transmitting power through a power transmission linkage operatively communicated with the power operator as said power operator reciprocates between the first power operator position and the second power operator position; and directing the flowing liquid to a reversing unit to adjust the control unit configuration to become disposed in the first control unit configuration when the power operator becomes disposed in the second power operator position, and to adjust the control unit configuration to become disposed in the second control unit configuration when the power operator becomes disposed in the first power operator position.

BRIEF DESCRIPTION OF THE DRAWINGS

A particularly preferred embodiment of the invention will be described in detail below in connection with the drawings in which.

DESCRIPTION OF PREFERRED EMBODIMENTS

Figure 1:
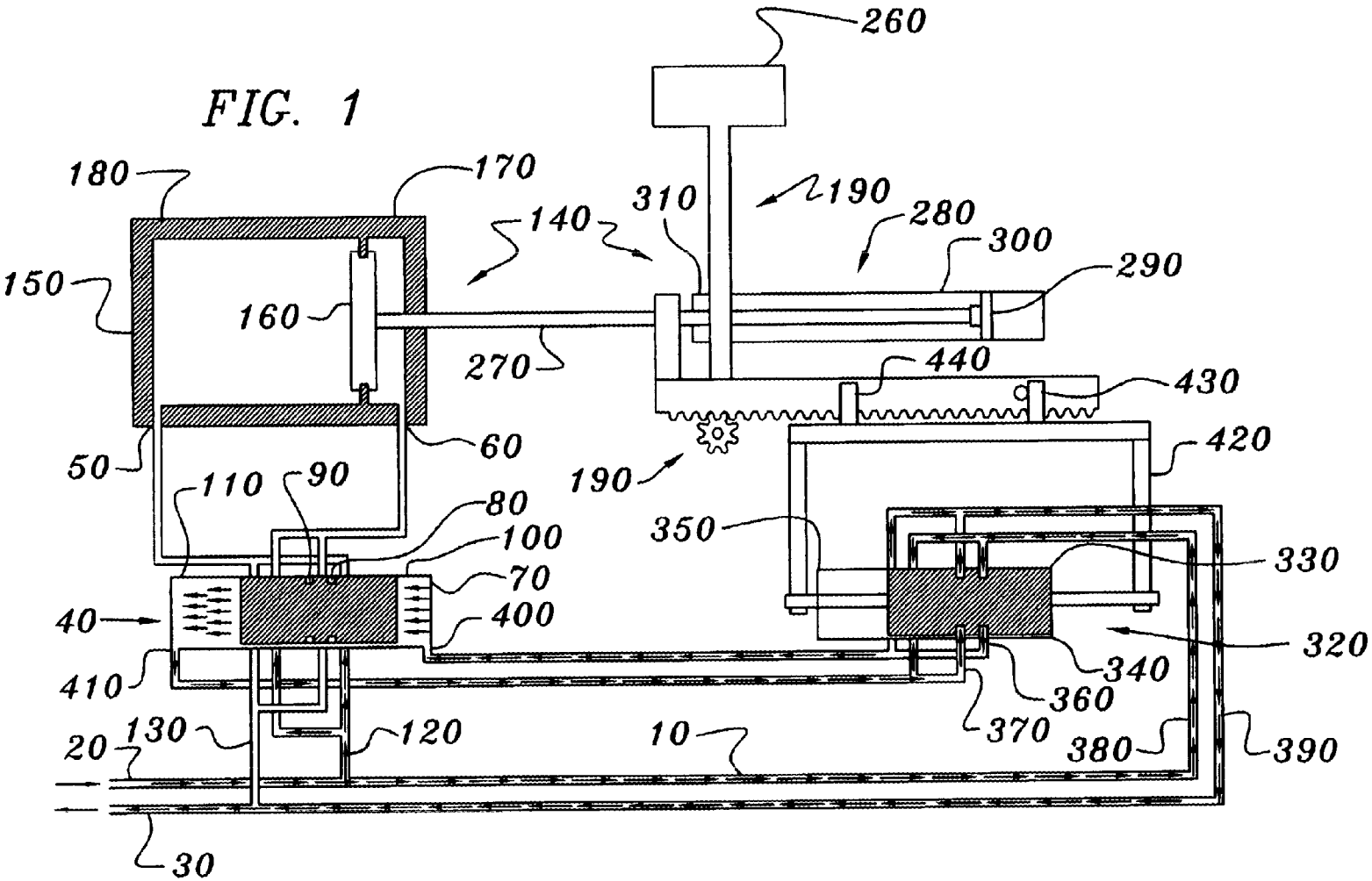
FIG. 1 is a plan view of an apparatus of this invention.

Particularly preferred embodiments of the present invention are illustrated in the drawings, which illustrate a preferable apparatus and method for generating power from a flowing liquid. FIG. 1 illustrates a preferred embodiment of the apparatus of the present invention. The apparatus allows a flowing liquid, represented in direction of movement by black arrows 10, to enter the apparatus through aperture 20, and the apparatus conveniently releases the flowing liquid through aperture 30. The apparatus preferably comprises a control unit generally indicated by reference numeral 40. The control unit is conveniently selectively operable between a first control unit configuration and a second control unit configuration for receiving the flowing liquid and selectively directing the flowing liquid to a first power unit aperture 50 when the control unit is in the first control unit configuration, and selectively directing the flowing liquid to a second power unit aperture 60 when the control unit is in the second control unit configuration.

A control unit operator 70 is preferably disposed in the control unit and suitably has ports 80 and 90 disposed in and through the control unit operator. The control unit operator 70 is preferably selectively operable between a first control unit operator position 100 and a second control unit operator position 110. Suitably, when the control unit operator is disposed in the first control unit operator position 100, the control unit is in the first control unit configuration. Conversely, when the control unit operator is disposed in the second control unit operator position 110, the control unit is in the second control unit configuration. Preferably, when the control unit operator is disposed in the first control unit operator position 100, the flowing liquid is directed to the first power unit aperture 50. Conversely, when the control unit operator is disposed in the second control unit operator position 110, the flowing liquid is directed to the second power unit aperture 60. Conveniently, the control unit operator can be such devices as a slide valve or a piston.

Preferably, the control unit 40 has a first control unit channel 120 and a second control unit channel 130. Suitably, when the control unit is in the first control unit configuration, the flowing liquid is directed to the power unit through the first control unit channel 120 to the first power unit aperture 50, and when the control unit is in the second control unit configuration, the flowing liquid is directed to the power unit through the first control unit channel 120 to the second power aperture 60. Conveniently, when the control unit is in the first control unit configuration, the flowing liquid exits the power unit through the second power unit aperture 60 to the second control unit channel 130, and when the control unit is in the first control unit configuration, the flowing liquid exits the power unit through the first power aperture 50 to the second control unit channel 130.

The apparatus also preferably comprises a power unit, generally indicated by reference number 140. The power unit suitably includes a power chamber 150 having the first power unit aperture 50 for receiving said flowing liquid from said control unit 40, and the second power unit aperture 60 for receiving a flowing liquid from said control unit 40.

Conveniently, a power operator 160 is operable between a first power operator position 170 and a second power operator position 180 and is disposed within the power chamber 150. The power operator 160 is suitably operatively configured so the power operator 160 becomes disposed in the first power operator position 170 when the control unit 40 is disposed in the first control unit configuration. Conversely, the power operator 160 becomes disposed in the second power operator position 180 when the control unit 40 is disposed in the second control unit configuration. The power unit may suitably be a piston.

Figure 2:
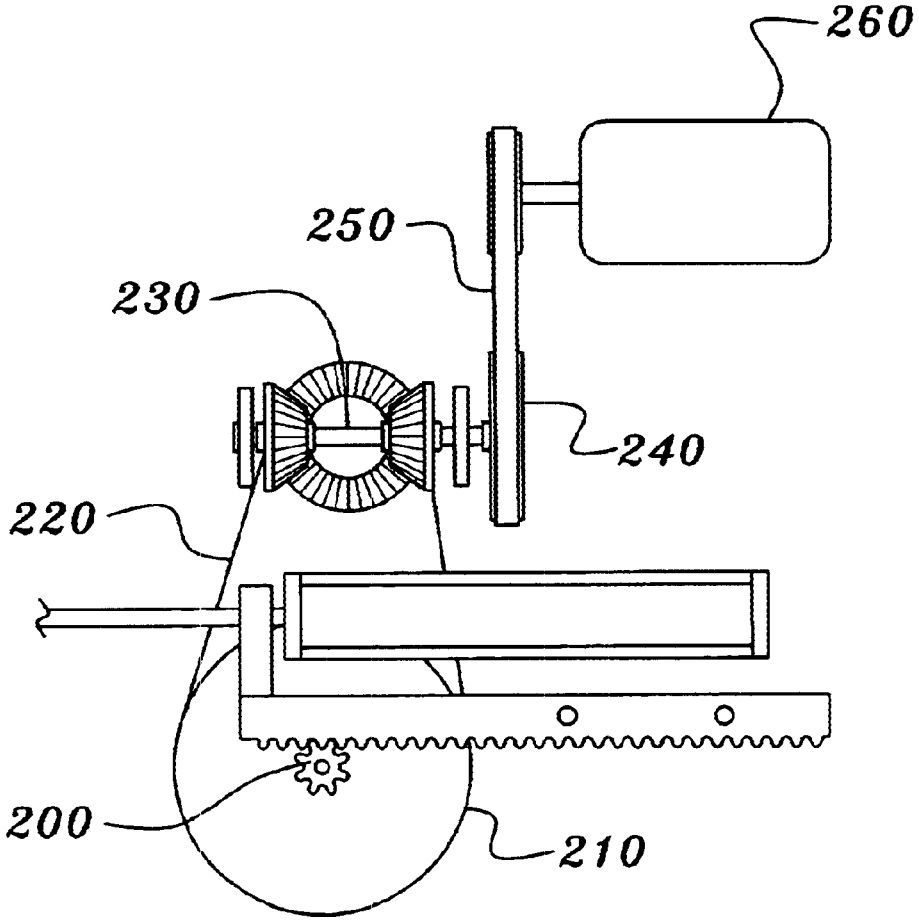
FIG. 2 is a plan view of a power transmission linkage of this invention.
Figure 3:
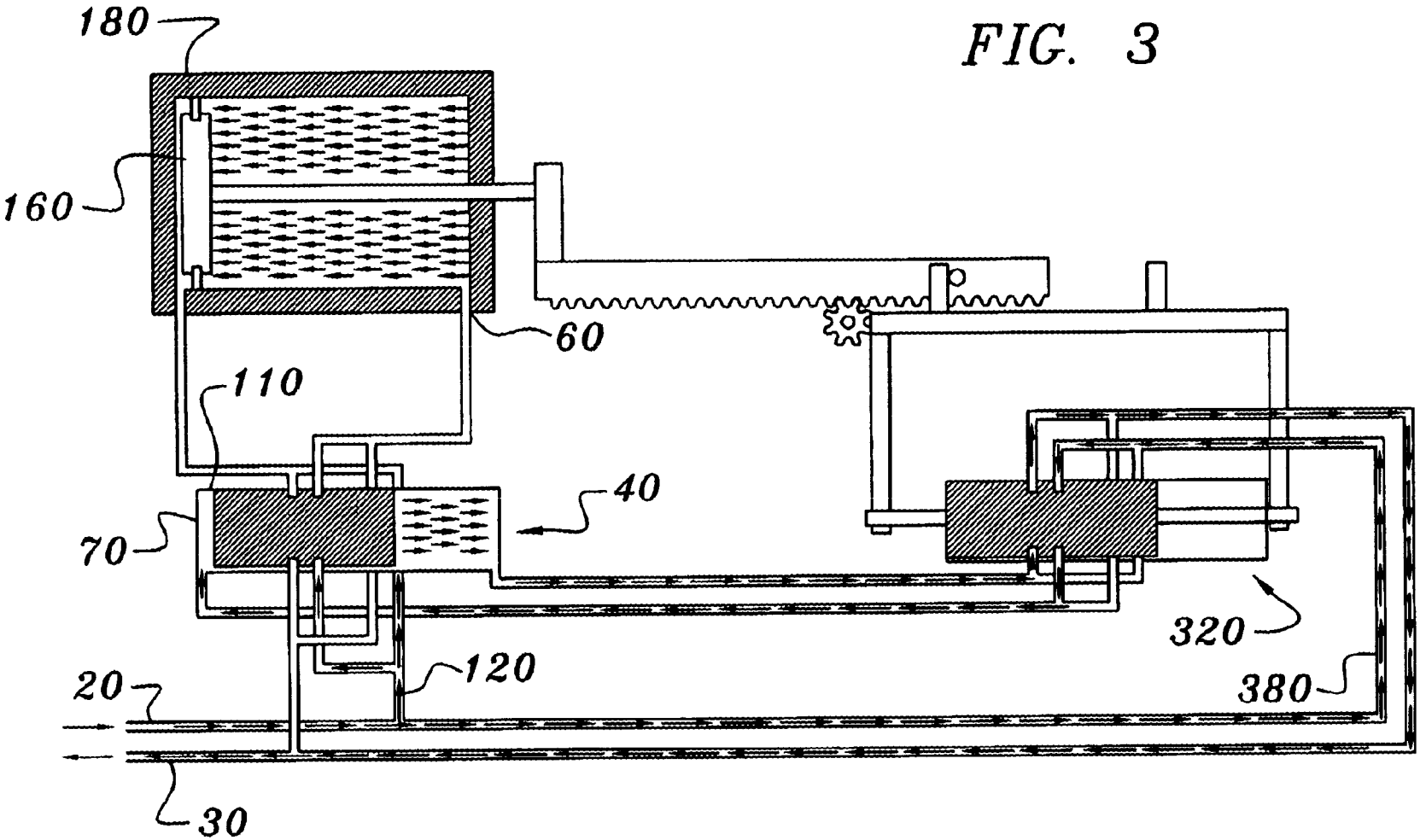
FIG. 3 is a plan view of an apparatus of this invention, illustrating the manner in which power is generated from a flowing liquid.

Preferably, a power transmission linkage, generally indicated by reference numeral 190 and herein illustrated by a rectangle representing any device used as a transmission known in the art, is operatively communicated with the power operator 160 for transmitting power as the power operator 160 reciprocates between the first power operator position 170 and the second power operator position 180. As illustrated in FIG. 2, the power transmission linkage 190 may suitably comprise a rack and spur gear 200, a sprocket 210, a chain 220, an output power shaft 230, a timing gear 240, and a timing belt 250. Conveniently, a power generator 260, herein illustrated by a rectangle representing any device used to generate power known in the art, is operatively associated with the power transmission linkage 190. In a preferred embodiment, the power transmission linkage 190 is operatively communicated with the power operator 160 by a shaft 270.

A compressed air generator, generally indicated by reference numeral 280, may also suitably be operatively associated with the power transmission linkage 190. As the power operator 160 reciprocates between the first power operator position 170 and the second power operator position 180, a piston 290 operable between a first piston position 300 and a second piston position 310 and contained in the compressed air generator 280 compresses air.

The apparatus also preferably comprises a reversing unit 320 to adjust the control unit configuration to become disposed in the first control unit configuration when the power operator 160 becomes disposed in the second power operator position 180, and to adjust the control unit configuration to become disposed in the second control unit configuration when the power operator becomes disposed in the first power operator position 170. Preferably, the reversing unit 320 adjusts the control unit configuration by selectively directing the flowing liquid to the control unit 40 through a first reversing unit channel 380 to a first control unit aperture 400 when the power operator 160 is in the first power operator position 170 and through the first reversing unit channel 380 to the second control unit aperture 410 when the power operator 160 is in the second power operator position 180.

Conversely, the flowing liquid exits the control unit 40 through the second control unit aperture 410 to the second reversing unit channel 390 when the power operator 160 is in the first power operator position 170, and the flowing liquid exits the control unit 40 through the first control unit aperture 400 to the second reversing unit channel 390 when the power operator 160 is in the second power operator position 180. Conveniently, the reversing unit 320 may be operatively communicated with the power transmission linkage 190 by a yoke 420 having a first strike 430 and a second strike 440.

A reversing unit operator 330 is preferably disposed in the reversing unit 320 and suitably has ports 360 and 370 disposed in and through the reversing unit operator 330. The reversing unit operator 330 is preferably selectively operable between a first reversing unit operator position 340 and a second reversing unit operator position 350. Preferably, the reversing unit operator 330 adjusts the control unit configuration to become disposed in the first control unit configuration when said power operator 160 becomes disposed in the second power operator position 180. Conversely, the reversing unit operator 330 adjusts the control unit configuration to become disposed in the second control unit configuration when the power operator 160 becomes disposed in the first power operator position 170. Conveniently, the reversing unit operator 330 may, among other things, be a slide valve or a piston.

FIGS. 3 through 11 illustrate the manner in which a preferred apparatus and method of this invention generates power from a flowing liquid. The manner in which this preferred apparatus operates may be explained by beginning at any of FIG. 3 through FIG. 10. For the sake of simplicity, the process is described beginning with FIG. 3, where the control unit operator 70 is disposed in the second control unit operator position 110. The flowing liquid enters the apparatus through aperture 20 and passes through the control unit 40 and the first control unit channel 120 into second power unit aperture 60, forcing the power operator 160 to the second power operator position 180. Upon reaching the second power operator position 180, the flowing liquid is directed through the reversing unit 320, the first reversing unit channel 380, and the reversing unit operator 330 to the second control unit aperture 410.

Figure 4:
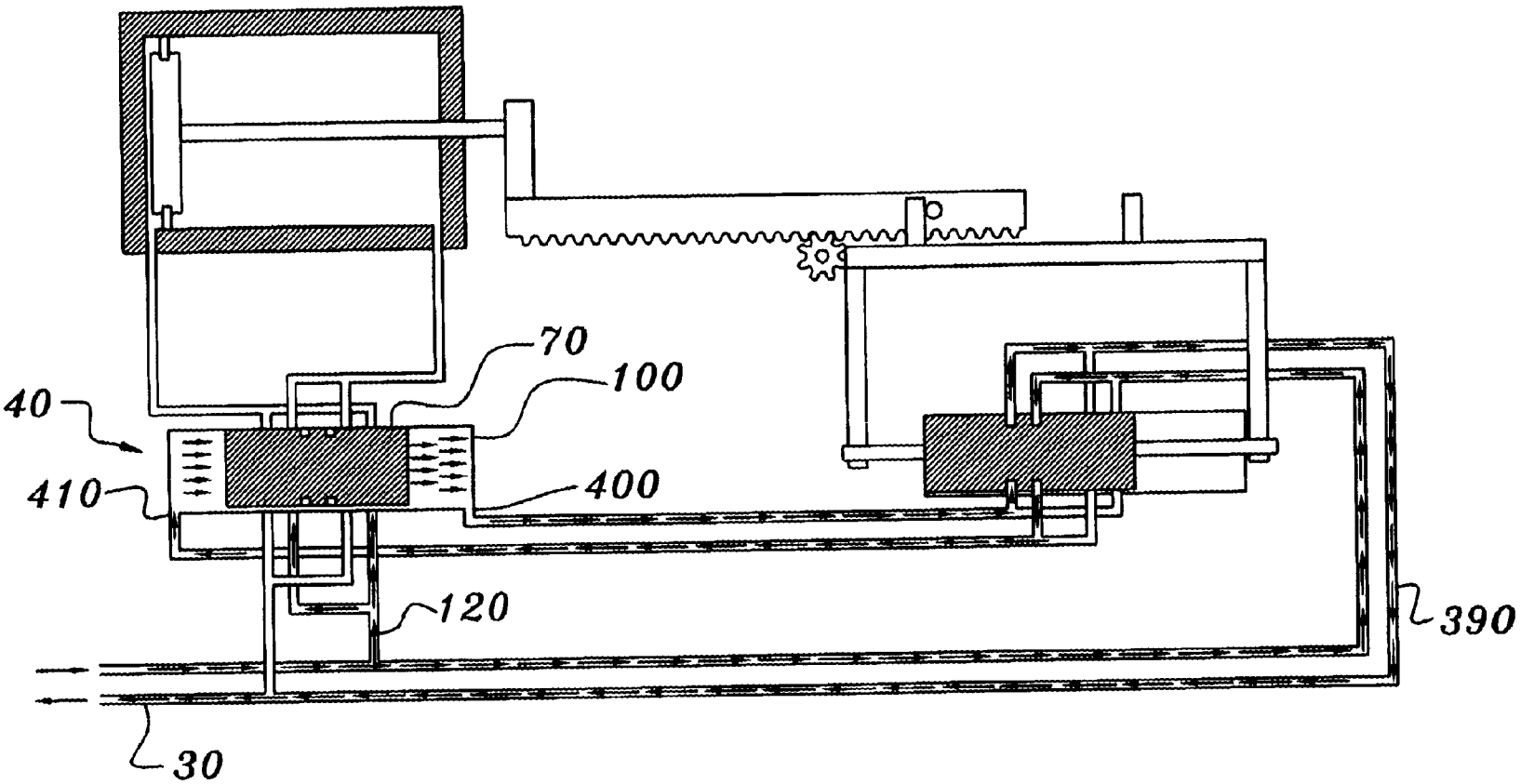
FIG. 4 is a plan view of an apparatus of this invention, illustrating the manner in which power is generated from a flowing liquid.

Looking at FIG. 4, as the flowing liquid enters the control unit 40 through the second control unit aperture 410, the control unit operator 70 begins to move towards the first control unit operator position 100, which forces the flowing liquid through the first control unit aperture 400 to the second reversing unit channel 390. The flowing liquid then exits the apparatus through port 30.

Figure 5:
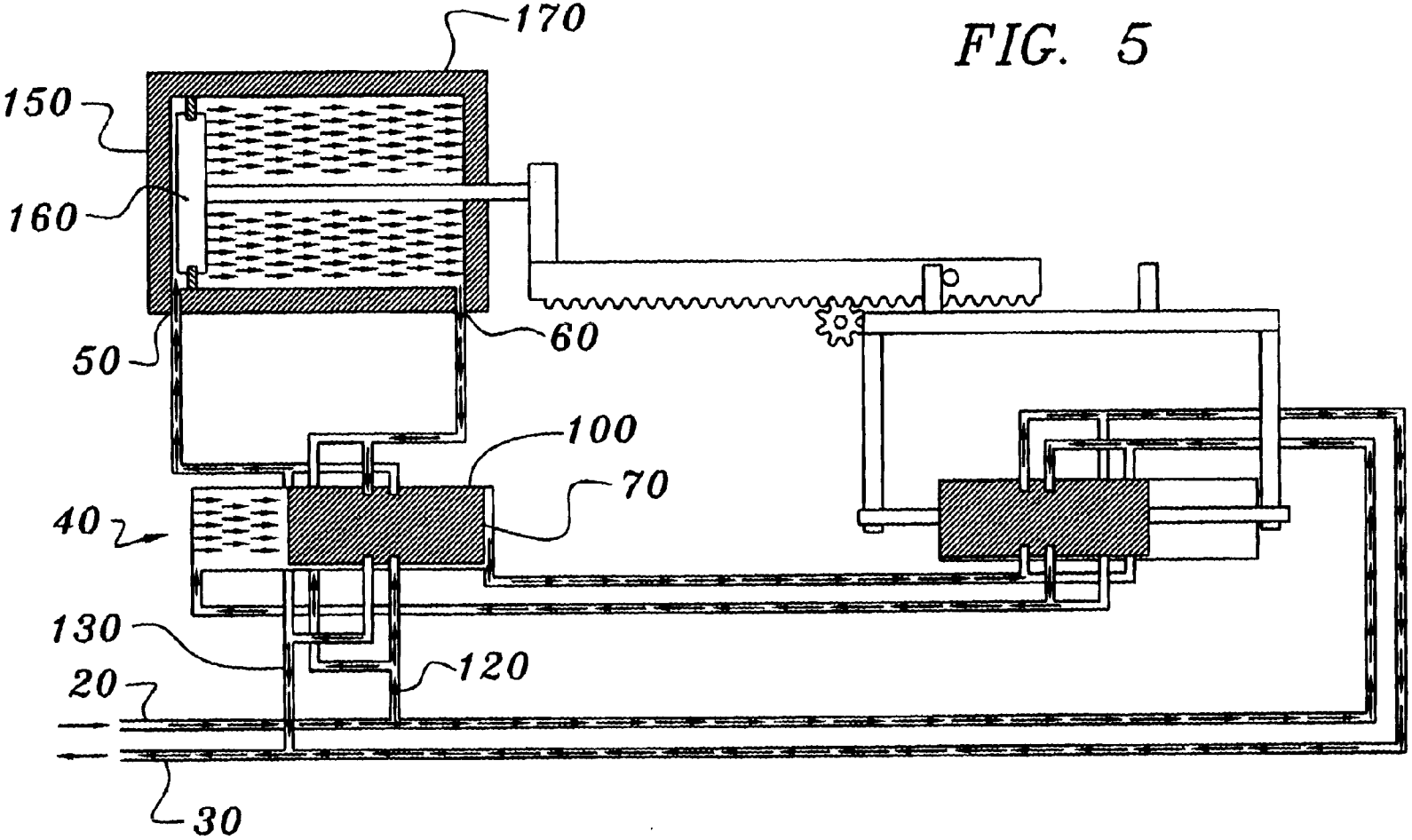
FIG. 5 is a plan view of an apparatus of this invention, illustrating the manner in which power is generated from a flowing liquid.

In FIG. 5, the control unit is disposed in the first control unit configuration and the control unit operator 70 has reached the first control unit operator position 100, forcing the flowing liquid entering the apparatus through port 20 to travel through the control unit 40 and the first control unit channel 120 to the first power unit aperture 50. This forces the power operator 160 to begin moving towards the first power operator position 170. As the power operator 160 moves towards the first power operator position 170, the flowing liquid exits the power chamber 150 through the second power unit aperture 60 to the second control unit channel 130. The flowing liquid then exits the apparatus through aperture 30.

Figure 6:
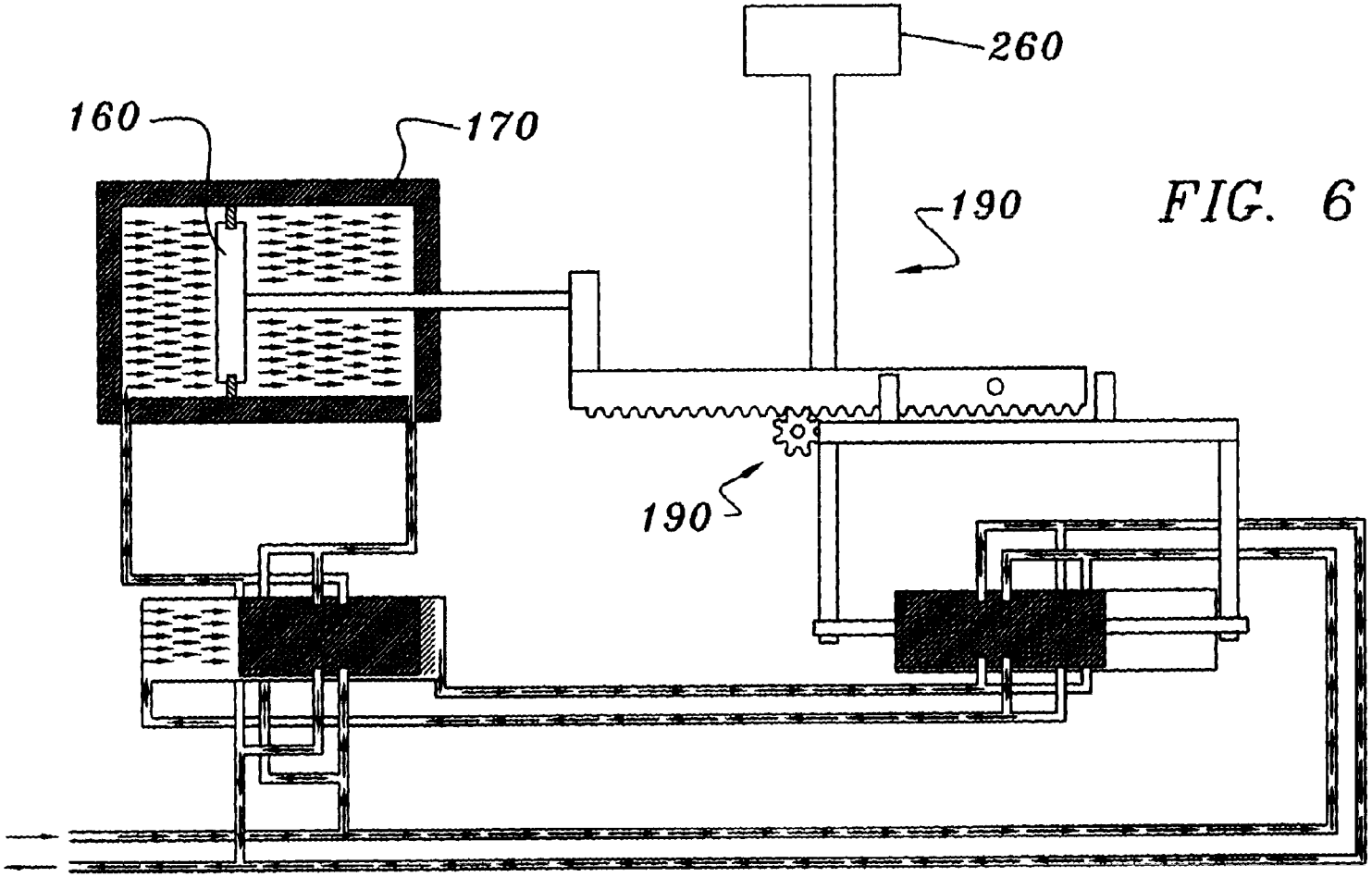
FIG. 6 is a plan view of an apparatus of this invention, illustrating the manner in which power is generated from a flowing liquid.

FIG. 6 illustrates the movement of the power operator 160 as the power operator is forced towards the first power operator position 170. As the power operator 160 travels to the first power operator position 170, the power operator forces the power transmission linkage 190 to move. This movement causes the power transmission linkage to transmit power to the power generator 260.

Figure 7:
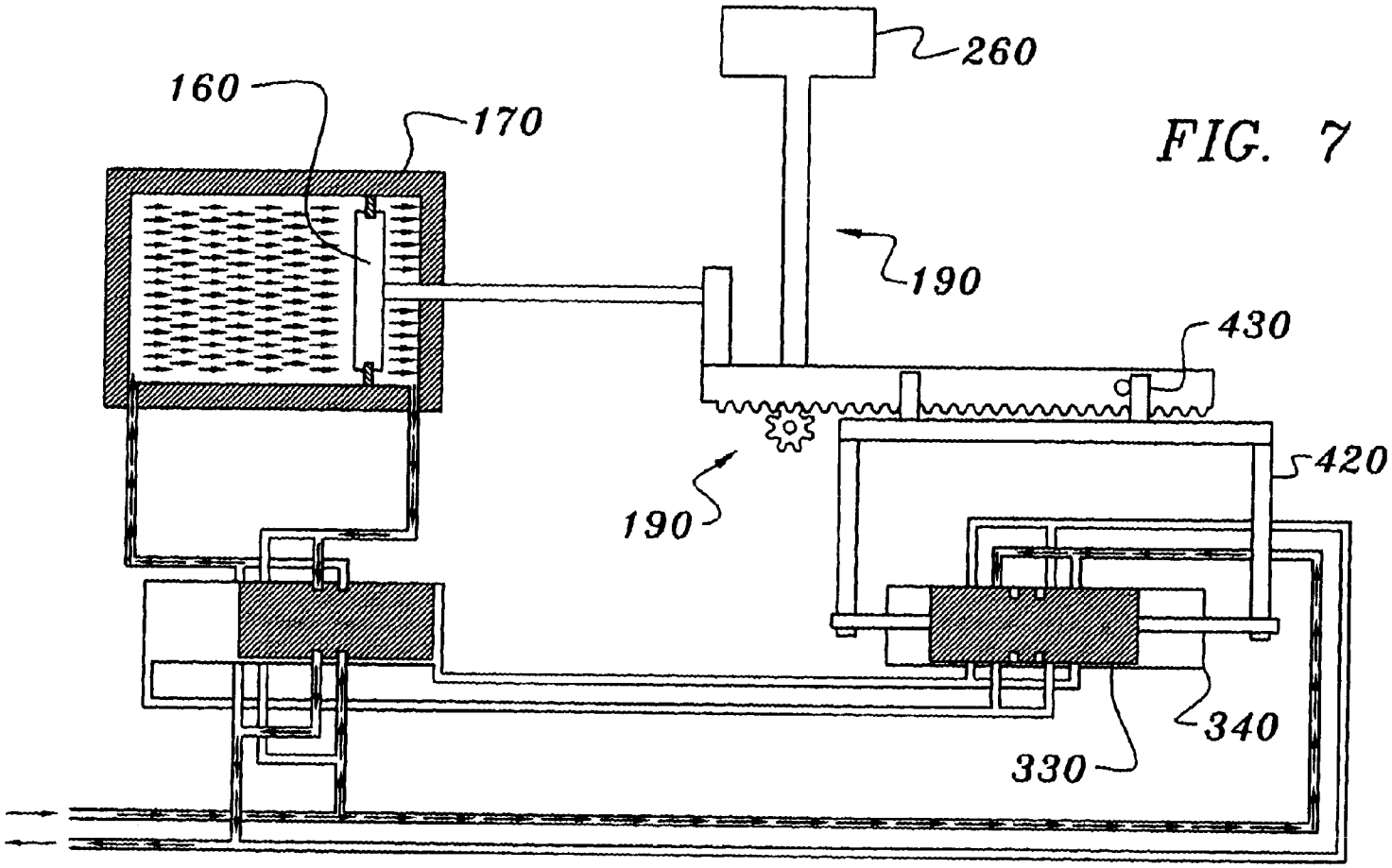
FIG. 7 is a plan view of an apparatus of this invention, illustrating the manner in which power is generated from a flowing liquid.

FIG. 7 illustrates the movement of the reversing unit operator 330 towards the first reversing unit operator position 340. The power transmission linkage 190 contacts the first strike 430 of the yoke 420. As the power operator 160 moves towards the first power operator position 170, the yoke 420 forces the reversing unit operator 330 towards the first reversing unit operator position 340. The movement of the power transmission linkage 190 continues to cause the power generator 260 to generate power.

Figure 8:
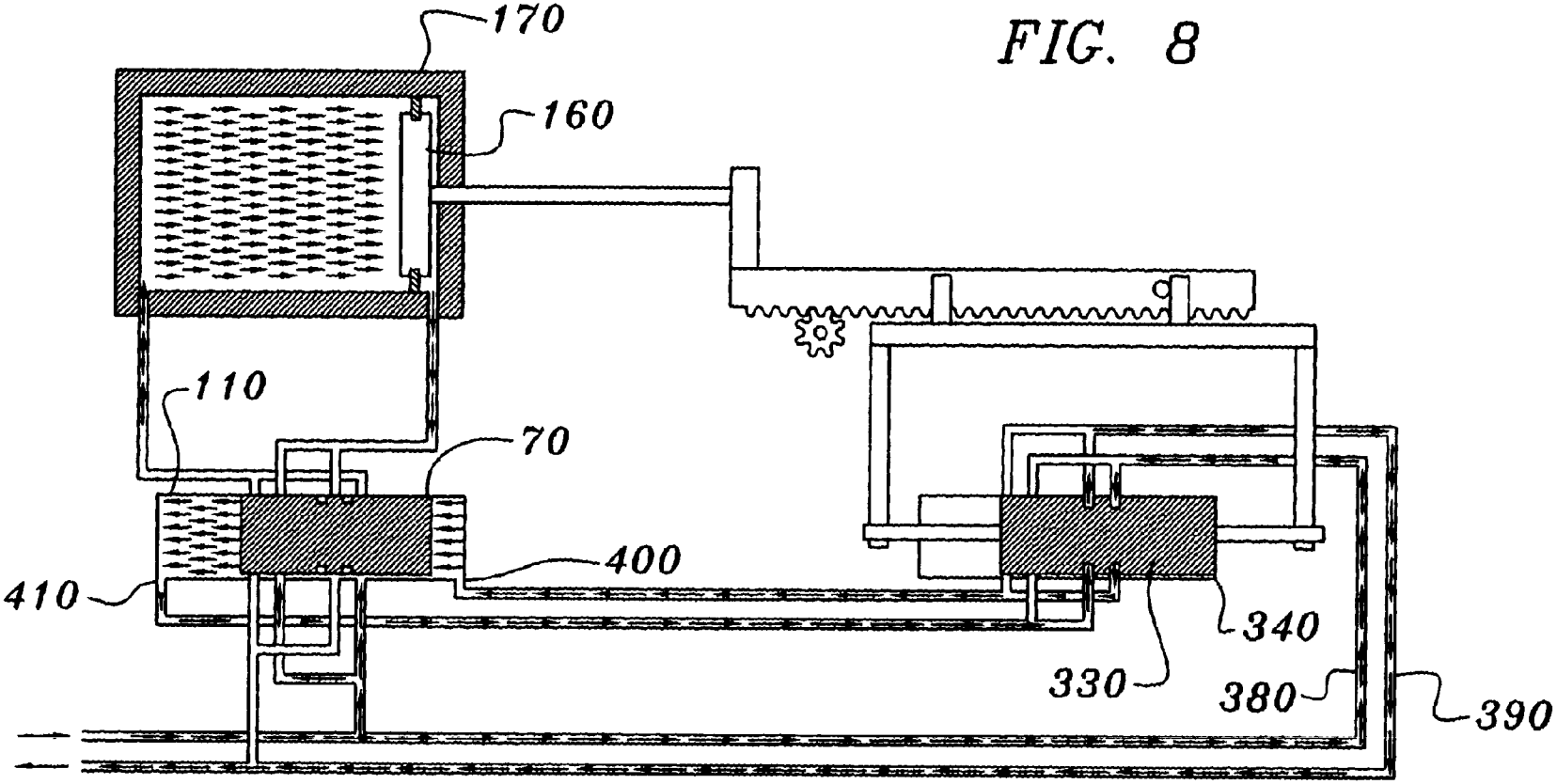
FIG. 8 is a plan view of an apparatus of this invention, illustrating the manner in which power is generated from a flowing liquid.

In FIG. 8, the power operator 160 completely moves to the first power operator position 170, thereby causing the reversing unit operator 330 to move completely to the first reversing unit operator position 340. As a result, the flowing liquid entering the apparatus travels through the first reversing unit channel 380 to the first control unit aperture 400. The flowing liquid forces the control unit operator 70 towards the second control unit operator position 110. As a result of the movement of the control unit operator 70, the flowing liquid exits the control unit 40 through the second control unit aperture 410 to the second reversing unit channel 390.

Figure 9:
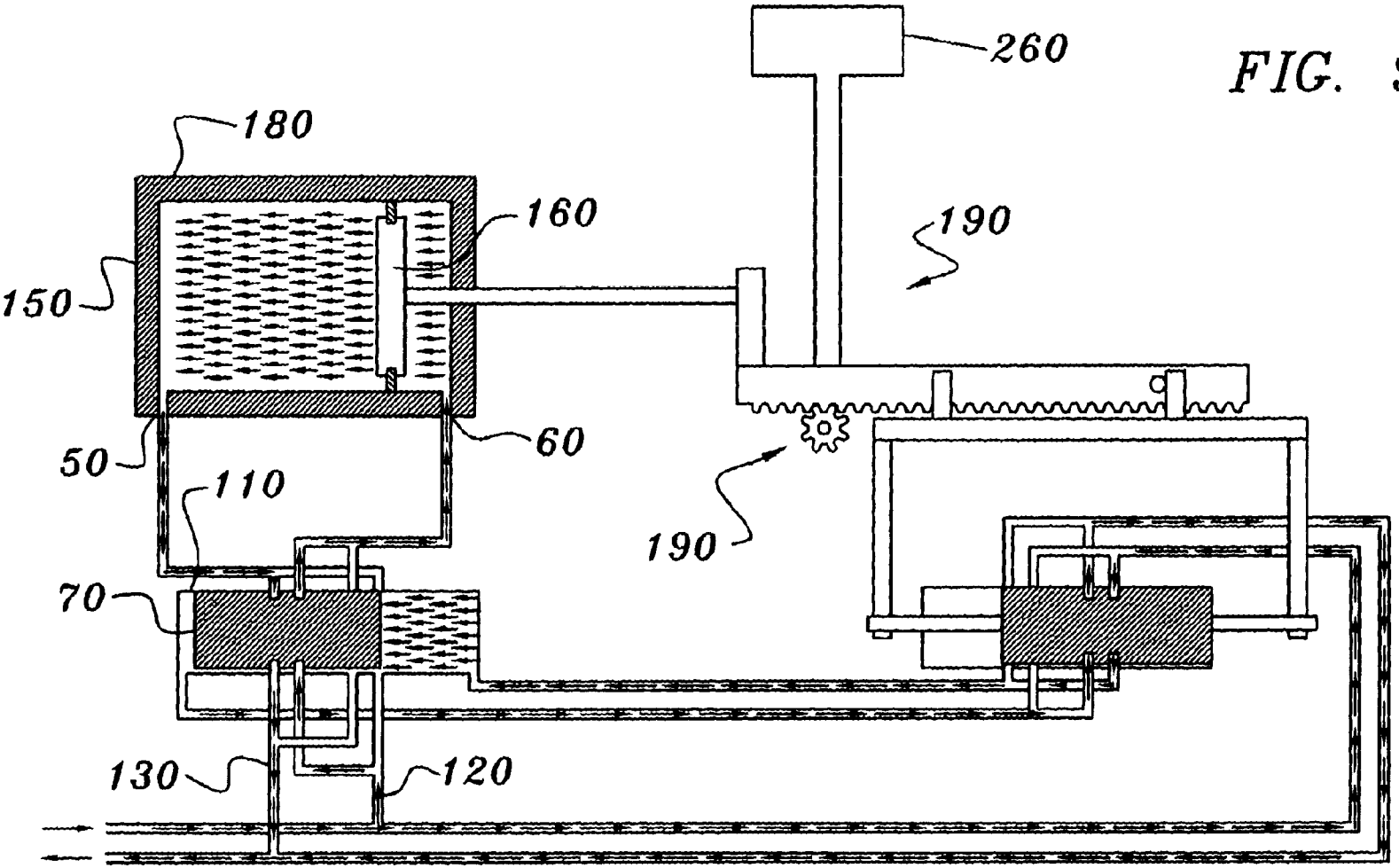
FIG. 9 is a plan view of an apparatus of this invention, illustrating the manner in which power is generated from a flowing liquid.

In FIG. 9, the control unit is disposed in the second control unit configuration and the control unit operator 70 is disposed in the second control unit operator position 110. This allows the flowing liquid to travel through the first control unit channel 120 to the second power unit aperture 60. Simultaneously, the power operator 160 moves towards the second power operator position 180, and flowing liquid is forced to exit the power chamber 150 through the first power unit aperture 50 to the second control unit channel 130. As the power operator 160 moves, the power transmission linkage 190 causes the power generator 260 to generate power.

Figure 10:
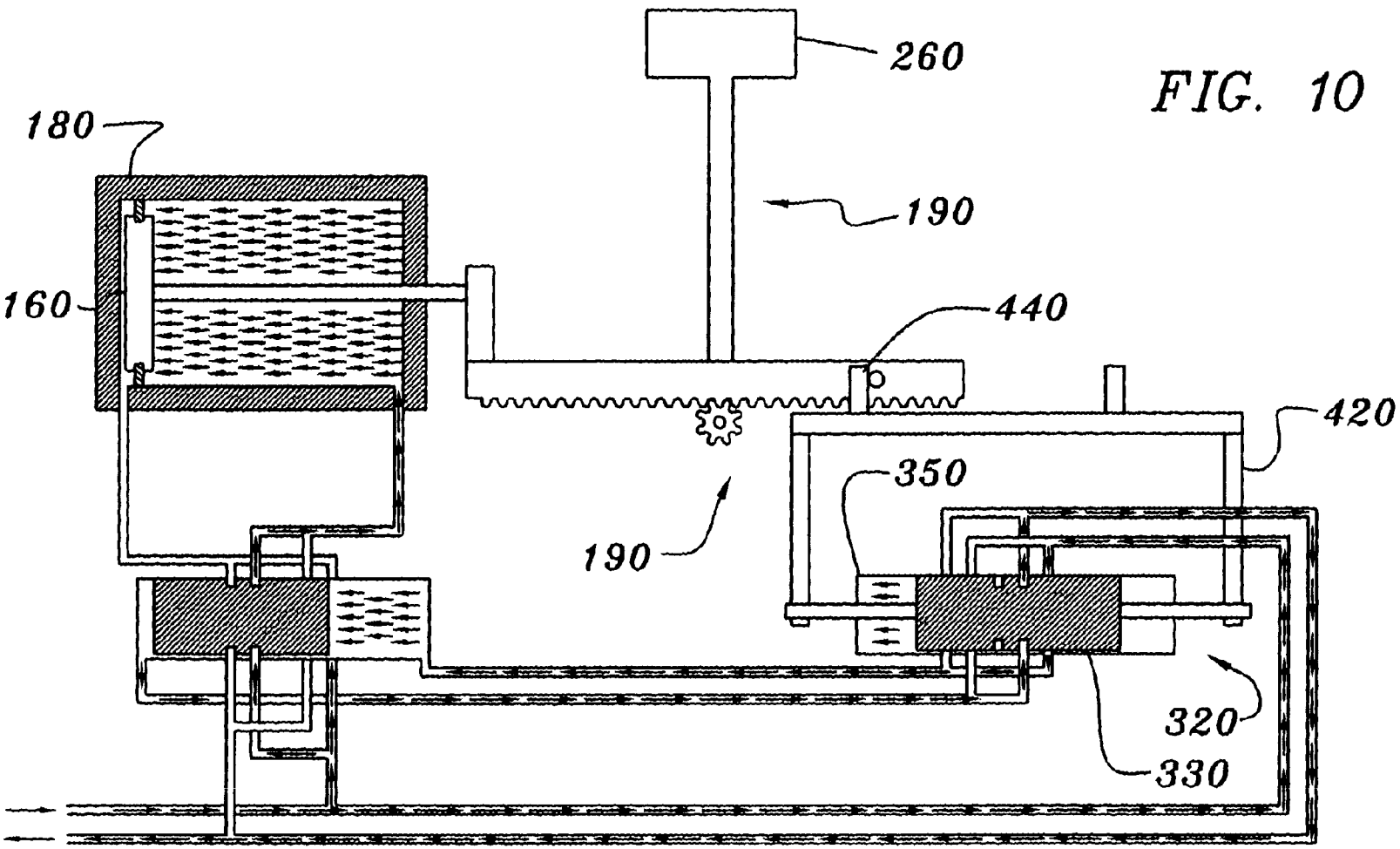
FIG. 10 is a plan view of an apparatus of this invention, illustrating the manner in which power is generated from a flowing liquid.

In FIG. 10, the power transmission linkage 190 contacts the second strike 440 of the yoke 420 as the power operator 160 proceeds towards the second power operator position 180. The movement of the power operator forces the reversing unit operator 330 towards the second reversing unit operator position 350. At this point, the apparatus has completed one full cycle, and the cycle begins again at FIG. 3.

Figure 11:
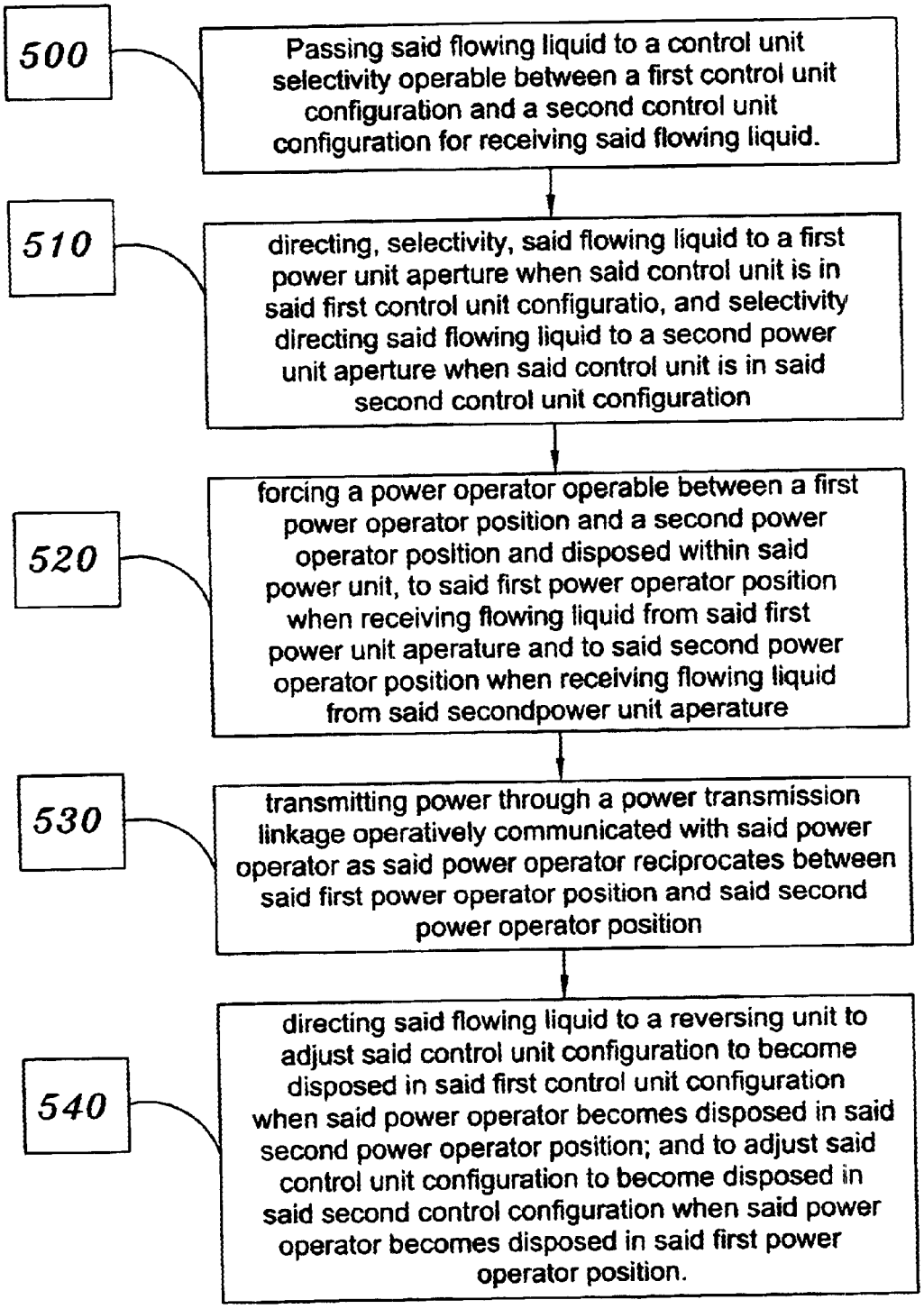
FIG. 11 is a flow chart illustrating a preferred method of this invention.

FIG. 11 illustrates a preferred method of this invention. An act is preferably passing 500 the flowing liquid to a control unit selectively operable between a first control unit configuration and a second control unit configuration for receiving said flowing liquid. Suitably, an act is directing 510, selectively, the flowing liquid to a first power unit aperture when the control unit is in the first control unit configuration, and selectively directing the flowing liquid to a second power unit aperture when the control unit is in the second control unit configuration.

Conveniently, an act is forcing 520 a power operator operable between a first power operator position and a second power operator position and disposed within the power unit, to the first power operator position when receiving flowing liquid from the first power unit aperture and to the second power operator position when receiving flowing liquid from the second power unit aperture.

Preferably, an act is transmitting 530 power through a power transmission linkage operatively communicated with the power operator as the power operator reciprocates between the first power operator position and the second power operator position.

Conveniently, an act is directing 540 the flowing liquid to a reversing unit to adjust the control unit configuration to become disposed in the first control unit configuration when the power operator becomes disposed in the second power operator position, and to adjust the control unit configuration to become disposed in the second control unit configuration when the power operator becomes disposed in the first power operator position.

What is claimed is:

1. An apparatus for generating power using a flowing liquid, comprising:

a control unit selectively operable between a first control unit configuration and a second control unit configuration for receiving said flowing liquid and selectively directing said flowing liquid to a first power unit aperture when said control unit is in said first control unit configuration, and selectively directing said flowing liquid to a second power unit aperture when said control unit is in said second control unit configuration;

a power unit for generating power, including a power chamber having said first power unit aperture for receiving said flowing liquid from said control unit, and a second power unit aperture for receiving a flowing liquid from said control unit;

a power operator operable between a first power operator position and a second power operator position and disposed within said power chamber, operatively configured so the power operator becomes disposed in said first power operator position when said control unit is disposed in said first control unit configuration; and so that the power operator becomes disposed in said second power operator position when said control unit is disposed in said second control unit configuration;

a power transmission linkage operatively communicating with said power operator for transmitting power as said power operator reciprocates between said first power operator position and said second power operator position;

wherein a compressed air generator is operatively associated with said power transmission linkage for generating compressed air as said power operator reciprocates between said first power operator position and said second power operator position, said compressed air generator containing a piston operable between a first piston position and a second piston position; and a reversing unit to adjust said control unit configuration to become disposed in said first control unit configuration when said power operator becomes disposed in said second power operator position, and to adjust said control unit configuration to become disposed in said second control unit configuration when said power operator becomes disposed in said first power operator position.

2. An apparatus for generating power using a flowing liquid, comprising:

a control unit selectively operable between a first control unit configuration and a second control unit configuration for receiving said flowing liquid and selectively directing said flowing liquid to a first power unit aperture when said control unit is in said first control unit configuration, and selectively directing said flowing liquid to a second power unit aperture when said control unit is in said second control unit configuration;

a power unit for generating power, including a power chamber having said first power unit aperture for receiving said flowing liquid from said control unit, and a second power unit aperture for receiving a flowing liquid from said control unit;

a power operator operable between a first power operator position and a second power operator position and disposed within said power chamber, operatively configured so the power operator becomes disposed in said first power operator position when said control unit is disposed in said first control unit configuration; and so that the power operator becomes disposed in said second power operator position when said control unit is disposed in said second control unit configuration;

a power transmission linkage operatively communicating with said power operator for transmitting power as said power operator reciprocates between said first power operator position and said second power operator position; and a reversing unit to adjust said control unit configuration to become disposed in said first control unit configuration when said power operator becomes disposed in said second power operator position, and to adjust said control unit configuration to become disposed in said second control unit configuration when said power operator becomes disposed in said first power operator position, and wherein a control unit operator selectively operable between a first control unit operator position and a second control unit operator position is disposed in said control unit for directing said flowing liquid to said first power unit aperture when said control unit operator is in said first control unit operator position, and selectively directing said flowing liquid to said second power unit aperture when said control unit operator is in said second control unit operator position, and wherein said flowing liquid exits said control unit through said second control unit aperture to said second reversing unit channel when said power operator is in said first power operator position, and said flowing liquid exits said control unit through said first control unit aperture to said second reversing unit channel when said power operator is in said second power operator position.

3. An apparatus for generating power using a flowing liquid, comprising:

a control unit selectively operable between a first control unit configuration and a second control unit configuration for receiving said flowing liquid and selectively directing said flowing liquid to a first power unit aperture when said control unit is in said first control unit configuration, and selectively directing said flowing liquid to a second power unit aperture when said control unit is in said second control unit configuration;

a power unit for generating power, including a power chamber having said first power unit aperture for receiving said flowing liquid from said control unit, and a second power unit aperture for receiving a flowing liquid from said control unit;

a power operator operable between a first power operator position and a second power operator position and disposed within said power chamber, operatively configured so the power operator becomes disposed in said first power operator position when said control unit is disposed in said first control unit configuration; and so that the power operator becomes disposed in said second power operator position when said control unit is disposed in said second control unit configuration;

a power transmission linkage operatively communicating with said power operator for transmitting power as said power operator reciprocates between said first power operator position and said second power operator position; wherein said power transmission linkage comprises a rack and a spur gear, a sprocket, a chain, an output power shaft, a timing gear, and a timing belt; and a reversing unit to adjust said control unit configuration to become disposed in said first control unit configuration when said power operator becomes disposed in said second power operator position, and to adjust said control unit configuration to become disposed in said second control unit configuration when said power operator becomes disposed in said first power operator position.

* * * * *